US009074356B2

(12) United States Patent
Tarantino

(10) Patent No.: US 9,074,356 B2
(45) Date of Patent: Jul. 7, 2015

(54) SYSTEMS AND METHODS FOR WATER CONSERVATION

(76) Inventor: Steven Fuller Tarantino, San Diego, CA (US)

( * ) Notice: Subject to any disclaimer, the term of this patent is extended or adjusted under 35 U.S.C. 154(b) by 83 days.

(21) Appl. No.: 13/229,790

(22) Filed: Sep. 12, 2011

(65) Prior Publication Data

US 2013/0061944 A1 Mar. 14, 2013

(51) Int. Cl.
*E03C 1/01* (2006.01)
*E03B 1/04* (2006.01)

(52) U.S. Cl.
CPC ..... *E03B 1/042* (2013.01); *Y10T 137/2536* (2015.04); *E03C 1/01* (2013.01); *E03B 1/048* (2013.01); *E03B 2001/045* (2013.01)

(58) Field of Classification Search
CPC . E03B 2001/04; E03B 2001/041; E03B 1/04; E03B 1/041; E03D 1/003; E03D 5/003; E03D 5/006
USPC ..... 4/664, 665, 602, 603, 615–617; 137/577, 268, 337
See application file for complete search history.

(56) References Cited

U.S. PATENT DOCUMENTS 2,105,314 A * 1/1938 Duncan et al. ..... 137/445
3,799,181 A 3/1974 Maddren
3,946,802 A 3/1976 Christenson
4,160,461 A 7/1979 Vataru
4,224,700 A 9/1980 Bloys
4,229,948 A 10/1980 Waters
4,262,842 A 4/1981 Grover, Jr.
4,300,247 A 11/1981 Berg
4,398,308 A 8/1983 Berg
4,554,688 A 11/1985 Puccerella
4,614,303 A 9/1986 Mosely, Jr.
5,105,846 A 4/1992 Britt
5,140,714 A 8/1992 Horenstein
5,165,456 A 11/1992 Woolman
5,173,180 A 12/1992 Stewart
5,192,426 A * 3/1993 DeCoster et al. ..... 210/117
5,233,706 A 8/1993 Maehr
5,261,443 A 11/1993 Walsh
5,274,860 A 1/1994 Avila
5,277,218 A * 1/1994 Sanchez ..... 4/665
5,285,537 A 2/1994 Hanks
5,339,859 A 8/1994 Bowman
5,341,529 A * 8/1994 Serrano ..... 4/665
5,345,625 A * 9/1994 Diemand ..... 4/665
5,353,448 A 10/1994 Lee
5,524,666 A 6/1996 Linn
5,557,812 A * 9/1996 Sayant ..... 4/665
5,564,462 A 10/1996 Storch
5,678,258 A 10/1997 Healy
5,689,843 A 11/1997 Duke
5,692,675 A 12/1997 Arlie
5,794,643 A 8/1998 Brice
5,862,544 A 1/1999 Placencia
6,164,307 A 12/2000 Byles
6,581,218 B1 6/2003 Koepenick, III
6,997,200 B2 2/2006 King
7,024,706 B2 4/2006 Hess (Continued)

*Primary Examiner* — Lauren Crane
*Assistant Examiner* — Erin Deery

(57) ABSTRACT

A system is described including a diverter valve operable to divert at least a portion of water flowing through a first water line to a first volume; a first float valve controlling water flow from a second water line to a second volume; and a second float valve controlling water flow from the first volume to the second volume.

6 Claims, 4 Drawing Sheets

(56) References Cited

U.S. PATENT DOCUMENTS

| | | | | |
|---|---|---|---|---|
| 7,178,543 | B2 | 2/2007 | Adams | |
| 7,490,373 | B1 | 2/2009 | Zavala-Avelar | |
| 7,694,898 | B2 | 4/2010 | Munoz Huerta | |
| 7,707,665 | B1 | 5/2010 | Hong | |
| 7,731,097 | B2 | 6/2010 | Honeychurch | |
| 7,857,240 | B2 | 12/2010 | Huang | |
| 2005/0217020 | A1 * | 10/2005 | Wade | 4/665 |
| 2008/0035760 | A1 | 2/2008 | Munoz Huerta | |
| 2009/0101212 | A1 | 4/2009 | Cullin | |
| 2009/0293190 | A1 | 12/2009 | Ringelstetter | |
| 2009/0293961 | A1 | 12/2009 | McMurtry | |
| 2009/0300839 | A1 | 12/2009 | Gay | |
| 2009/0308955 | A1 | 12/2009 | Zhou | |
| 2010/0051107 | A1 | 3/2010 | Crawford | |
| 2010/0095451 | A1 | 4/2010 | Quinn | |
| 2010/0294860 | A1 | 11/2010 | Hsieh | |

* cited by examiner

SYSTEMS AND METHODS FOR WATER CONSERVATION

FIELD

The present invention pertains generally to systems and methods for water conservation. More particularly, the present invention pertains to systems and methods for reusing water from a faucet or shower when the faucet or shower is initially operated and before the water is at a suitable temperature.

BACKGROUND

Less than 2% of the Earth's water supply is fresh water suitable for watering crops, landscaping, drinking and domestic use. Industrial processes also consume large quantities of fresh water. In a typical domestic setting, landscaping can account for about half of water consumption, showers/bathing account for another 18 percent and toilets use about 20 percent.

Many regions throughout the world experience fresh water shortages due to their relatively dry climate and/or distance from fresh water lakes, rivers, streams and aquifers. In some areas, fresh water shortages occur periodically and are dependent on seasonal rainfall and/or regional snow pack levels. Many areas receive water through expensive man-made infrastructure such as aqueducts and man-made reservoirs. As the population increases in these areas, addition infrastructure is required to supply fresh water needs. In addition to fresh water supply infrastructure, sewer treatment plants are required in most areas to process sewer water. A reduction in water usage can decrease the size and operational costs of water supply infrastructure and treatment plants.

In a typical domestic setting, fresh water from a supply line is fed to a thermostatically controlled water heater having a tank holding about 30 to 100 gallons of heated water, or more. These water heaters are often located in garages, closets or other remote locations that are distanced from the point of use (i.e. shower, bath or sink). In multi-family dwellings, one centralized, hot water heater may service several (and in some cases, dozens, or more) dwellings and in these installations, the distance between the water heater and each point of use can be large.

After a hot water use, water in the hot water supply line between the water heater and point of use cools to a temperature dependent of the ambient temperature and the time period between hot water uses. When a user requires hot water, they often must first evacuate the cold water standing in the line before water at a suitable temperature from the water heater tank reaches the point of use. This cold, unused water is often passed directly to the drain, wasting a large amount of fresh water and adversely impacting water treatment plants.

In light of the above, Applicant discloses Systems and Methods for Water Conservation.

SUMMARY

In one aspect of the present disclosure, a system is described herein which may comprise a diverter valve operable to divert at least a portion of water flowing through a first water line to a first volume; a first float valve controlling water flow from a second water line to a second volume; and a second float valve controlling water flow from the first volume to the second volume.

In one embodiment of this aspect, the system further comprises a first tank housing the first volume and a second tank housing the second volume.

In one arrangement, the first and second volumes are compartments of a single tank.

In one setup, the second float valve comprises a concentric float valve.

In one implementation, the second float valve comprises a float and arm valve.

In a particular embodiment of this aspect, the float and arm valve is oriented in an approximately vertical orientation.

In one arrangement, the first float valve establishes a desired fill height in the second volume and the first volume is positioned higher that the desired fill height.

In one particular arrangement, the first volume is at least twice as large as the second volume.

In another aspect, a system is described herein which may comprise a hot water line; a cold water line; a mixing valve assembly receiving water from the hot water line and cold water line and outputting water to a mix line; a diverter valve receiving water from the mix line and having a first output and a second output; a dispenser positioned to receive water from the first output; and a tank positioned to receive water from the second output.

In one embodiment of this aspect, the dispenser is selected from the group of dispensers comprising a showerhead, shower wand, showerhead—wand combination and a tub spout.

In one embodiment, the system may further comprise a thermostatic shutoff valve positioned to receive water from said second output.

In one implementation, the system may further comprise a temperature indicator indicating water temperature in said mix line.

In a particular implementation, the system may further comprise a check valve positioned to receive water from said second output.

In one embodiment of this aspect, the cold water line is a first cold water line, the diverter valve is arranged to flow water through the second output to a first volume, and the system further comprises a first float valve regulating water from a second cold water line to a second volume and a second float valve regulating water from the first volume to the second volume.

In one embodiment, the diverter valve is a three-way diverter valve.

In one implementation, wherein the diverter valve is arranged to flow water through the second output to a first volume, and the system further comprises a flapper valve regulating water from the first volume to a second volume.

In a particular implementation, the tank is an outdoor water storage tank.

In another aspect, a system for directing cooled water standing in a hot water line to a toilet cistern is described herein which may comprise a storage tank; a valve operable to direct at least a portion of the cooled standing water to the storage tank; and a float valve controlling water flow from the storage tank to the toilet cistern.

In one embodiment of this aspect, the valve is a diverter valve.

In one implementation, the hot water line delivers water to a showerhead.

DETAILED DESCRIPTION

Figure 1:
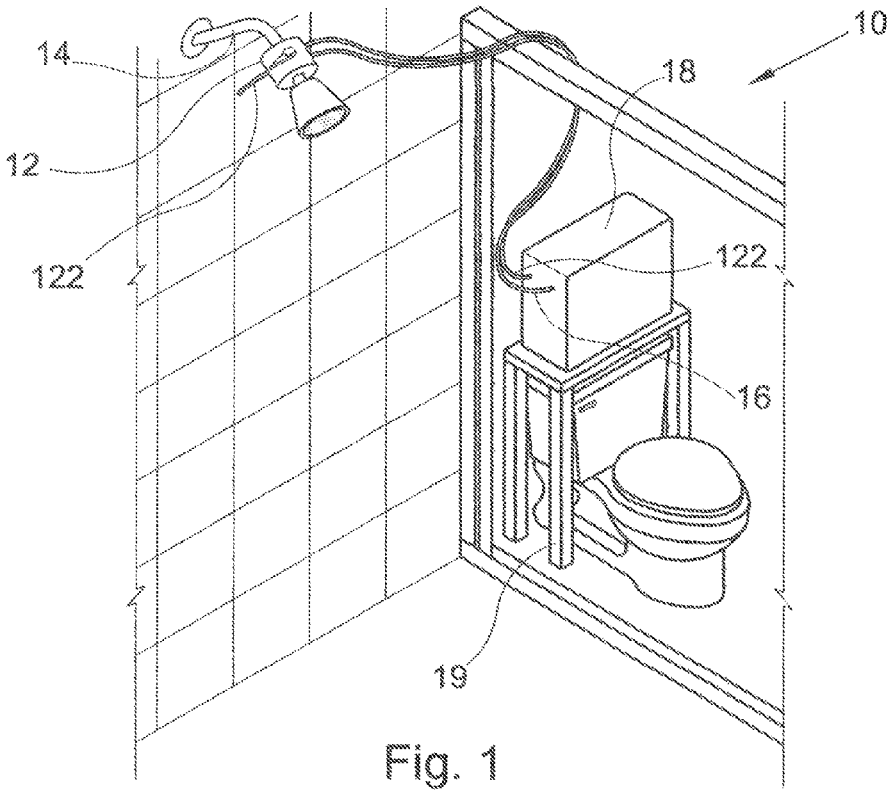
FIG. 1 shows a simplified, perspective view of a system for diverting and storing water for subsequent use.

Referring to FIG. 1, a system for diverting and storing water for subsequent use is shown and generally designated 10. As shown in FIG. 1, the system 10 includes a diverter valve 12 on line 14 adjustable to selectively divert at least a portion of water in line 14 to line 16 for flow into tank 18. As shown in FIG. 1, tank 18 can be positioned above a standard toilet tank and supported by a stand 19, made, for example, of metal or wood, which extends to the floor. Alternatively, tank 18 may be secured to a wall, placed on a floor or positioned in an attic space. In some setups, tank 18 may be sized larger than a standard toilet tank, for greater storage and/or to provide emergency flush capability in the event of a water outage. For example, in one arrangement, tank 18 may be sized to hold approximately eight gallons of water allowing for six emergency flushes of approximately 1.2 gallons each.

The term "diverter valve" as used herein is a broad term, and is to be given its ordinary and customary meaning to a person of ordinary skill in the art (and is not to be limited to a special or customized meaning), and refers without limitation to an arrangement which includes a portion movable in response to an actuation to stop and/or reduce flow along one or more conduits and increase flow along one or more conduits. Actuation can be manual using, for example, a handle, lever, button or knob, which may be movable continuously or incremental through a plurality of positions, or actuation may be hydraulic, pneumatic or electrical, such as by solenoid or motor. For example, a diverter valve may consist of a tee having an input port and two or more output ports with at least one valve operable at an output port or downstream thereof. In some cases, additional valves may be placed at other output ports or downstream thereof, with the multiple valves operated individually or in concert. As another example, a diverter valve may consist of a tee having an input port and two or more output ports with a ball or other rotatable member formed with a through hole and positioned at the junction between ports to selectively direct flow to the output ports.

The term "valve" as used herein is a broad term, and is to be given its ordinary and customary meaning to a person of ordinary skill in the art (and is not to be limited to a special or customized meaning), and refers generally and without limitation to devices that regulate, direct and/or control the flow of fluid in one or more conduits by opening, closing, and/or partially obstructing one or more passageways. Examples include all types of valves which are suitable for a particular purpose, including, without limitation, ball valves, butterfly valves, check valves, choke valves, diaphragm valves, gate valves, globe valves, knife valves, needle valves, pinch valves, piston valves, poppet valves, flapper valves and plug valves.

Figure 2:
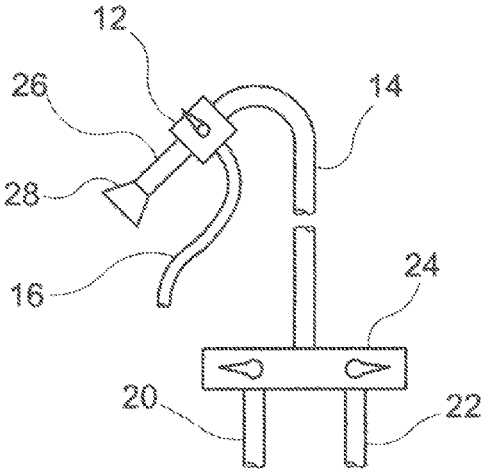
FIG. 2 shows a schematic view showing a mixing valve assembly and mix line.

As best seen by cross-referencing FIGS. 1 and 2, in one implementation, water from cold water line 20 and hot water line 22 are input to mixing valve assembly 24 which outputs water on mix line 14. As shown, diverter valve 12 can be placed on mix line 14 to control flow between line 16 and line 26. Dispenser 28 can be operably attached, for example, using a male-female threaded joint to line 26, as shown. In some arrangements (not shown), the dispenser 28 can be directly attached to the diverter valve 12. In some arrangements, the diverter valve 12 or line 26 may be formed with an input port (not shown) to receive line 122 (see also FIG. 10) to allow overflow from the tank 18 to flow from the tank 18 and through the dispenser 28 (not shown).

The term "mixing valve assembly" as used herein is a broad term, and is to be given its ordinary and customary meaning to a person of ordinary skill in the art (and is not to be limited to a special or customized meaning), and refers generally and without limitation to devices that combine liquids flowing in two or more input conduits into a combined flow in an output conduit including, without limitation, mixer taps for baths, showers, sinks and laundry tubs such as commercially available or custom mixer taps having separate valves and separate handles for each input conduit, commercially available or custom mixer taps having a valve or valves controlled by a single handle, commercially available or custom mixer taps having a pressure balancing feature so that the hot/cold mixture ratio will not be affected by transient changes in the pressure of one or the other of the supplies, and commercially available or custom thermostatic mixing valves for maintaining output water temperature or preventing output above a pre-selected water temperature, for example, to prevent scalding.

The term "dispenser" as used herein is a broad term, and is to be given its ordinary and customary meaning to a person of ordinary skill in the art (and is not to be limited to a special or customized meaning), and refers generally and without limitation to devices that dispense water from a conduit such as a hot water line, cold water line or mix line including, without limitation, faucets, showerheads, shower wands, showerhead/wand combinations, tub spouts, hose bibs and drinking fountains.

Figure 3:
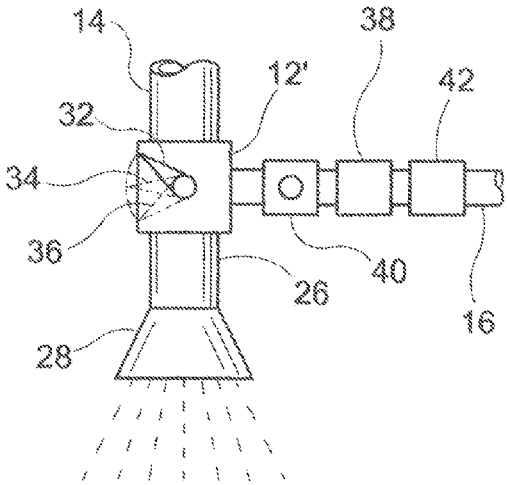
FIG. 3 shows a schematic view illustrating a diverter valve and optional components on a diverter valve output line.

FIG. 3 shows an arrangement showing one or more optional components that can be including in the system 10 shown in FIG. 1. As shown in FIG. 3, water from line 14 flows into three-way diverter valve 12' that includes three discreet lever positions (shown as one solid line lever 32 and dotted line levers 34, 36) allowing manual adjustment between positions. Specifically, with lever in position 32, approximately all flow in line 14 is diverted to line 16, with lever in position 34, approximately fifty percent of flow in line 14 is diverted to line 16 while the remaining fifty percent flows to dispenser 28, and with lever in position 36, approximately all flow in line 14 flows to dispenser 28.

Continuing with FIG. 3, it can be seen that an optional check valve 38 can be positioned in line 16 to prevent water from line 16 or downstream tank 18 from flowing back into the diverter valve 12'. Specifically, check valve 38 remains open to allow flow from diverter valve 12' to tank 18 and closes during a flow from tank 18 toward valve 12'. In alternative embodiments, optional check valve 38 may be positioned in line 26, in line 14 or may be integral with diverter valve 12' or dispenser 28. FIG. 3 also illustrates that an optional temperature indicator 40 can be provided in line 16. Optional temperature indicator 40 may provide a positive visual or auditory indication when water in line 16 reaches a pre-selected temperature or may provide a plurality of indications, with each indication corresponding to a specific pre-selected temperature. Examples of suitable temperature indicators are known in the art and include LED displays connected to a suitable sensor(s), or can include one or more materials which change color or transparency when heated to a pre-selected temperature. Example of such materials are described in U.S. Pat. No. 6,997,200 issued to King and titled "Water Conservation System", the contents of which are hereby incorporated by reference herein. In alternative embodiments, temperature indicator 40 may be positioned in line 26, in line 14 or may be integral with diverter valve 12', dispenser 28 or mixing valve assembly 24 (shown in FIG. 2).

Figure 4:
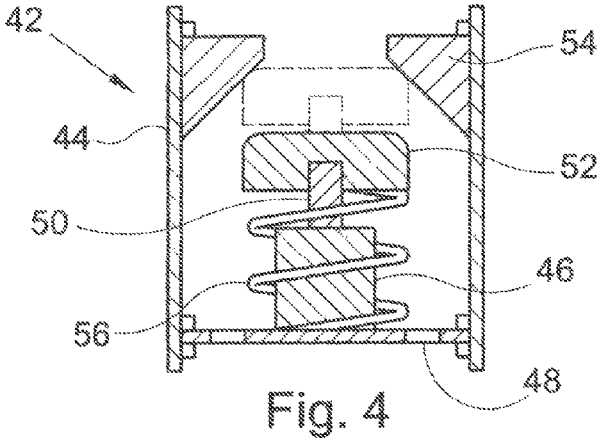
FIG. 4 shows a simplified, sectional, view of a thermostatic shutoff valve.

FIG. 3 also illustrates that an optional thermostatic shutoff valve 42 can be provided in line 16 operable to close when water in line 16 reaches a pre-selected temperature. In use, a user can place diverter valve 12' in position corresponding to solid line lever 32 and adjust mixing valve assembly 24 to output water from hot water line 22 into mix line 14. Water will then flow into tank 18 until a pre-selected temperature is reached in line 16 at which time thermostatic shutoff valve 42 will close and water flow will stop until the user places diverter valve 12' in a position corresponding to dotted line lever 34 or 36. The optional check valve 38, optional temperature indicator 40 and optional thermostatic shutoff valve 42, if included in the system, may be included alone or in combination. For example, the optional check valve 38 may be included alone, or may be include with the optional temperature indicator 40, or may be included an optional temperature indicator 40 and optional thermostatic shutoff valve 42. FIG. 4 shows a simplified example of a thermostatic shutoff valve 42 which is similar to an automotive thermostatic shutoff valve. Unlike an automotive thermostatic shutoff valve designed to open and allow flow of automotive coolant from an engine block to a radiator when a pre-selected coolant temperature is reached, the thermostatic shutoff valve 42 operates in reverse, closing when a pre-selected temperature is reached. As shown in FIG. 4, thermostatic shutoff valve 42 can include a conduit 44 such as a pipe or tube, insertable into line 16. A sealed canister 46 can be mounted in conduit 44 via plate 48 which is formed with holes to allow water to flow through plate 48. A material such as wax can be placed in canister 46, which, at a pre-selected temperature expands to cause output shaft 50 to translate disc 52 into seat 54 (as illustrated by the dotted lines). A spring 56 can be provided to bias the thermostatic shutoff valve 42 in the open position. Other thermostatic shutoff valve constructions known in the art may be used.

Figure 5:
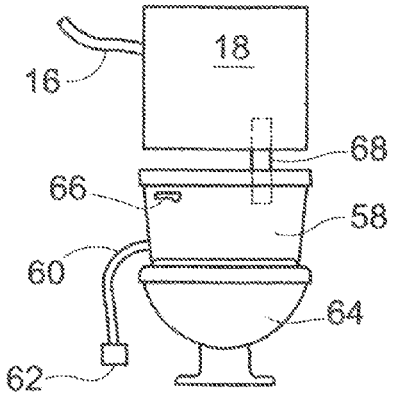
FIG. 5 shows a plan view of a toilet and storage tank assembly.

Referring now to FIG. 5, an arrangement is shown in which the contents of tank 18 can be used in a flush toilet system. As shown, flush toilet system can include a toilet tank 58 (sometimes referred to as a "cistern") fillable by cold water input line 60 having emergency/service shutoff valve 62. Contents of toilet tank 58 are flowable into toilet bowl 64 by manually actuating flush lever 66 to flush material from bowl 64 into a sewer or septic system.

FIG. 5 also shows that a valve 68 may be provided to control flow from a first volume in tank 18 to a second volume in tank 58. For example, valve 68 may be a flapper valve openable during manual actuation of flush lever 66 (i.e. flush lever 66 opens valve 68 and a second flapper valve which releases the contents of tank 58 into bowl 64). An example of this type of arrangement is shown and described in U.S. Pat. No. 6,997,200 issued to King and titled "Water Conservation System", the contents of which are hereby incorporated by reference herein.

Alternatively, as described in further detail below, valve 68 may be a float valve. The term "float valve" as used herein is a broad term, and is to be given its ordinary and customary meaning to a person of ordinary skill in the art (and is not to be limited to a special or customized meaning), and refers without limitation to an arrangement which includes a float portion movable with the surface of a liquid and a valve portion responsive to float portion movement to stop, reduce, increase and/or divert a flow along one or more conduits. Examples include without limitation, concentric float valves, float and arm valves including side float designs where the arm is mounted on a pivot near the valve portion and pivot-less in-line designs.

Figure 6:
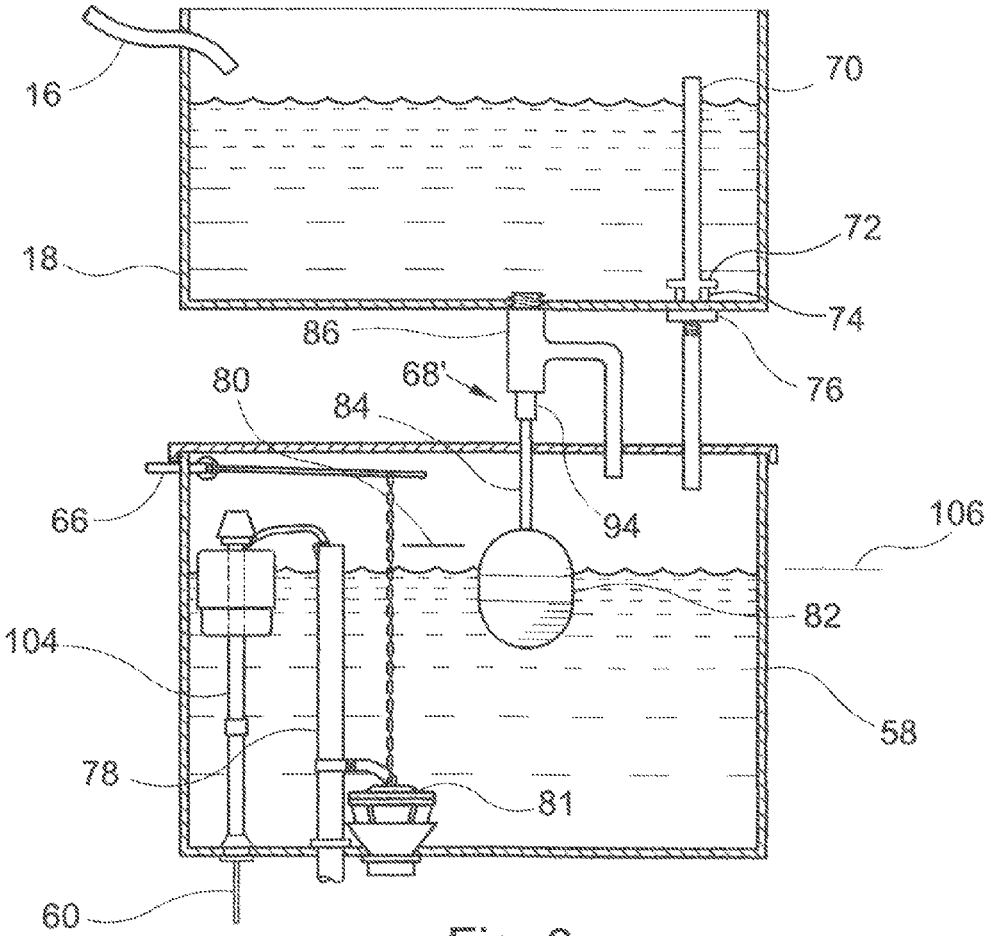
FIG. 6 shows a view of the internal components of a toilet tank and storage tank assembly.

FIG. 6 shows an arrangement in which a pivot-less in-line float valve 68' is used to control flow from a first volume in tank 18 to a second volume in tank 58. As shown, water from line 16 flows into tank 18 and is stored there until water is released into toilet tank 58. Line 16 may extend from a diverter valve 12 (as shown in FIG. 1) which is employed in conjunction with a showerhead, or may extend from other sources such as one or more faucets, bath tubs, etc. For example, U.S. Pat. No. 6,997,200 issued to King and titled "Water Conservation System", the contents of which are hereby incorporated by reference herein, discloses a device in which water can be diverted from a mixing valve assembly employed in conjunction with a sink faucet. Thus, tank 18 may be fed from the device suggested by King (U.S. Pat. No. 6,997,200) or any other device which diverts water which would otherwise be fed into a drain system including so-called gray water (i.e. wastewater generated from domestic activities such as laundry, dishwashing, and bathing) that is clean enough to be processed through tank 58 without clogging or contaminating the components of the arrangement shown in FIG. 6. In some instances, gray water that has been treated and/or filtered may be supplied to tank 18.

As further shown in FIG. 6, tank 18 can be outfitted with a system to prevent overflow in which case tank 18 can be an unsealed tank. For the arrangement shown in FIG. 6, an overflow tube 70 is mounted in tank 18 to pass overflow water via a through-hole formed in the bottom wall of tank 18 and into tank 58. Standard plumbing techniques can be used to seal the overflow tube 70 to the bottom wall such as the flange 72, elastomeric seal 74 and nut 76 arrangement shown, or a male-female threaded attachment can be used (not shown). Also shown, tank 58 may be equipped with a similar overflow tube 78 establishing a maximum fill line 80 for tank 58 and a flapper valve 81 openable by manually actuating flush lever 66 to release water from tank 58 into toilet bowl 64 (shown in FIG. 5). The term "flapper valve" as used herein is a broad term, and is to be given its ordinary and customary meaning to a person of ordinary skill in the art (and is not to be limited to a special or customized meaning), and refers without limitation to an arrangement which includes a flapper and seat including an arrangement in which the flapper is designed to sink more slowly than the water flowing through the open flapper valve. Overflow tube 78 can be mounted in tank 58 to pass overflow water via a through-hole formed in the bottom wall of tank 58 and into bowl 64 (shown in FIG. 5) which can include a gooseneck output port maintaining the residual level in bowl 64. Alternatively, tank 18 can be a sealed vessel and an output line can be provided to route overflow water to another drain, e.g. through overflow line 122 (see FIGS. 1 and 10 and corresponding description provided below), or back to the dispenser line which originally diverted water to tank 18 (not shown) or to another storage tank such as the storage tank 124 shown in FIG. 11. For example, as shown in FIG. 1, overflow line 122 can be attached to the diverter valve 12 and have an open overflow line end to direct overflow water to a shower drain.

Once in tank 18, water below the overfill height can be stored until valve 68' opens to flow water from tank 18 to tank 58. As shown in FIG. 6, float valve 68' includes a float 82 attached to a shaft 84. Float 82 can be a sealed hollow member (as shown), for example, made of rubber or plastic, or can be a solid or closed pore material that is shaped to float on the surface of water in tank 58. For the arrangement shown in FIG. 6, shaft 84 can be coupled to valve 86, which in turn, is fed from tank 18. Standard plumbing techniques can be used to seal the float valve 68' to the bottom wall of tank 18, such as the male-female threaded attachment shown, or a flange, elastomeric seal and nut arrangement such as the one described above for overflow tube 70.

Figure 7:
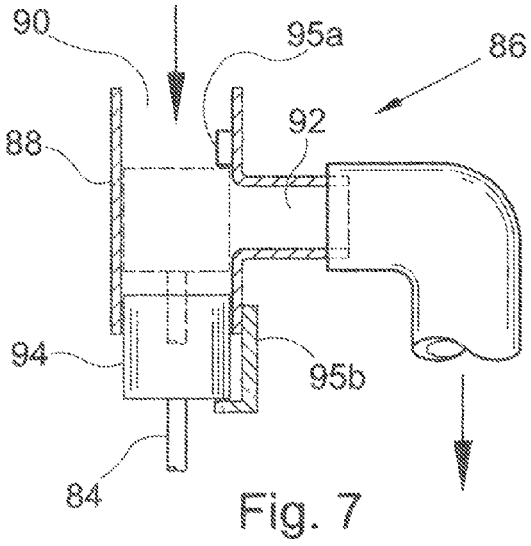
FIG. 7 shows a sectional view of a valve for use in a float valve.

FIG. 7 shows a detail view of an example of a valve 86 for use in the float valve 68' shown in FIG. 6. As shown in FIG. 7, valve 86 can include a tee housing 88 having input port 90 in fluid communication with tank 18 and having output port 92. Plug 94 can be attached to or made integral with shaft 84 and shaped to move, back and forth, within tee housing 88 between a first position (shown as solid lines) in which the valve 86 is open and water is allowed to flow from input port 90 to output port 92, and a second position (shown as dashed lines) in which the valve 86 is closed and water is prevented from flowing from input port 90 to output port 92. A light spring (not shown) may be provided to bias the plug 94 into the first position. Stops 95*a,b* can be used to limit travel of the plug 94 and/or retain the plug 94 in the tee housing 88.

Figure 8:
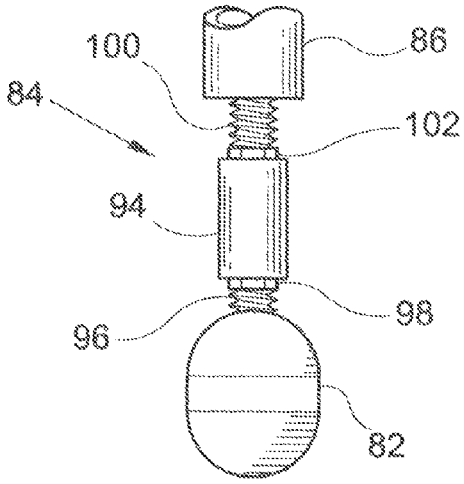
FIG. 8 illustrates an embodiment of a portion of a float valve having an adjustable shaft length.

FIG. 8 shows an optional arrangement in which the length of shaft 84 can be adjusted to set the distance between float 82 and valve 86, and establish a water level in tank 58 where valve 86 begins to close. As seen there, an adjustment block 94 having internal, female threads can be provided. Shaft portion 96 having external male threads couples float 82 to adjustment block 94 and can be threaded into adjustment block 94 at a selected depth and secured with lock nut 96. If desired, a second threaded shaft portion 100 can be employed to couple valve 86 to adjustment block 94 and can be threaded into adjustment block 94 at a selected depth and secured with lock nut 102. Other arrangements known in the art to adjust the length of shaft 84 may be used.

Referring back to FIG. 6, it can be seen that float valve 68' may be aligned in an approximately vertical orientation such that the float 82, shaft 68' and plug 94 move in an approximately vertical direction in response to a change in water level in tank 58. The term "approximately vertical" as used herein is a broad term, and is to be given its ordinary and customary meaning to a person of ordinary skill in the art (and is not to be limited to a special or customized meaning), and refers without limitation to a degree of vertical orientation within the normal tolerances used by a person of ordinary skill in the art in the design, manufacture, assembly and installation of components in the art.

Continuing with FIG. 6, it can be seen the float valve 104 can be employed in tank 58 to control water flow from cold water input line 60 to establish a desired fill height 106 in tank 58. Although a concentric type float valve is shown for the float valve 104, it is to be appreciated that other types of float valves, such as a float and arm type, including, but not limited to side float designs and pivot-less in-line designs, can be used. With float valve 104 open, a portion of water from input line 60 can be directed into tank 58 and a portion directed into overflow tube 78 to fill the toilet bowl after a flush. In one setup, float valve 104 is adjusted to establish a desired fill height 106 in tank 58 and float valve 68' is adjusted such that valve 86 is fully closed before the rising water level in tank 58 reaches the desired fill height.

The arrangement shown in FIG. 6 provides a consistent flushing volume independent of the presence or amount of water in tank 18. The relative sizes of the output ports of float valve 68' and float valve 104 can be set, or in some cases, adjusted to the fraction of water from input line 60 and the fraction of water from tank 18 that is used to refill tank 58. For example, the diameter of valve 86 may be larger than the diameter of input line 60.

Figure 9:
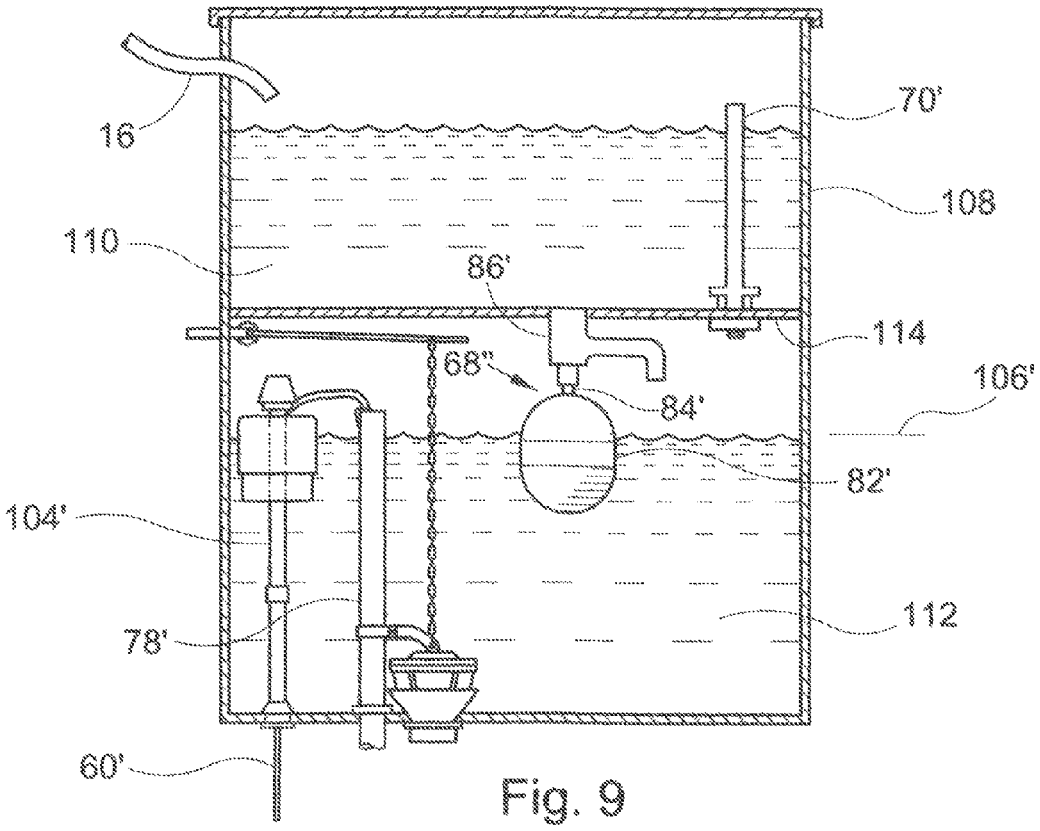
FIG. 9 shows a view of the internal components tank having a toilet compartment and a storage compartment.

FIG. 9 shows another arrangement having a single tank 108 with internal compartment 110 and compartment 112. Divider 114 seals compartment 110 from compartment 112, as shown. FIG. 9 shows an arrangement in which a float valve 68" is used to control flow from a first volume in compartment 110 to a second volume in compartment 112. As shown, water from line 16 (as described above) flows into compartment 110 and is stored there until water is released into compartment 112.

As further shown in FIG. 9, compartment 110 can be outfitted with a system to prevent overflow in which case compartment 110 can be an unsealed tank. For the arrangement shown in FIG. 9, an overflow tube 70' is mounted in compartment 110 to pass overflow water via a through-hole formed in the divider 114 and into compartment 112. Also shown, compartment 112 may be equipped with a similar overflow tube 78' establishing a maximum fill height for compartment 112. Alternatively, compartment 110 can be a sealed vessel and an output line can be provided to route overflow water to another drain, back to the dispenser line which originally diverted water to compartment 110 (see FIGS. 1 and 10 and corresponding description provided below) or to another storage tank. Once in compartment 110, water below the overfill height can be stored until valve 86' opens to flow water from compartment 110 to compartment 112. As shown in FIG. 9, float valve 68" includes a float 82', shaft 84' and valve 86' (as described above with reference to FIGS. 6-8).

Continuing with FIG. 9, it can be seen the float valve 104' can be employed in compartment 112 to control water flow from cold water input line 60' to establish a desired fill height 106' in compartment 112. In one setup, float valve 104' is adjusted to establish a desired fill height 106' in compartment 112 and float valve 68" is adjusted such that valve 86' is fully closed before the rising water level in compartment 112 reaches the desired fill height. The arrangement shown in FIG. 9 provides a consistent flushing volume independent of the presence or amount of water in compartment 110.

Figure 10:
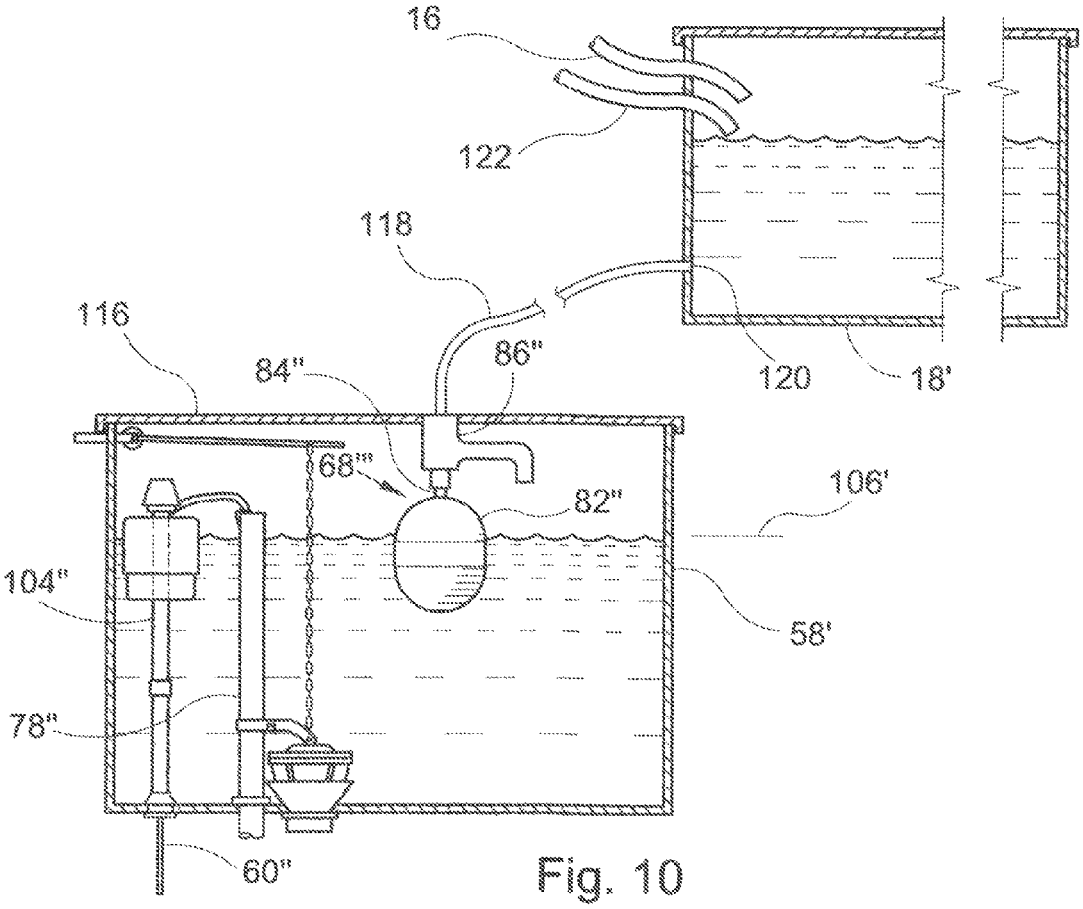
FIG. 10 shows a view of the internal components of a toilet tank and storage tank assembly in which a storage tank can be positioned at a distance from (and not necessarily located directly above) a toilet tank.

FIG. 10 shows another arrangement having a storage tank 18' that can be positioned at a distance from (and not necessarily located directly above) tank 58'. Water from line 16 (as described above) flows into tank 18' and is stored there until water is released into tank 58'. For the arrangement shown in FIG. 10, a float valve 68" can be attached to lid 116 of tank 58' and used to control flow from a first volume in tank 18' via line 118 to a second volume in tank 58'. Output 120 can be positioned at a higher elevation than valve 86" to allow gravity to feed water from tank 18' via line 118 to valve 86". As shown in FIG. 10, float valve 68" includes a float 82', shaft 84' and valve 86' (as described above with reference to FIGS. 6-9).

FIG. 10 also shows that an overflow line 122 can be provided on an output port of tank 18' (shown also in FIG. 1). Overflow water can be routed to tank 58', another drain, back to the dispenser line which originally diverted water to tank 18' or to another storage tank. For the case where the overflow water is routed to a location at a higher elevation than the overflow output port of tank 18', tank 18' can be a sealed vessel (see FIG. 1). For the case where the overflow water is routed to a location at a lower elevation than the overflow output port of tank 18', tank 18' can be an unsealed vessel. Alternatively, an overflow tube (described above) can be mounted in tank 18' to pass overflow water via a through-hole in tank 18' to a line (not shown) which then leads to a suitable drain, dispenser line or tank. Once in tank 18', water below the overfill height can be stored until valve 68''' opens to flow water from tank 18' to tank 58'.

FIG. 10 also shows that tank 58' may be equipped with an overflow tube 78'' establishing a maximum fill height for tank 58'. Also shown, float valve 104'' in tank 58' controls water flow from cold water input line 60' to establish a desired fill height 106'' in tank 58'. In one setup, float valve 104'' is adjusted to establish a desired fill height 106' in tank 58' and float valve 68'' is adjusted such that valve 86' is fully closed before the rising water level in tank 58' reaches the desired fill height. The arrangement shown in FIG. 10 provides a consistent flushing volume independent of the presence or amount of water in tank 18'.

Figure 11:
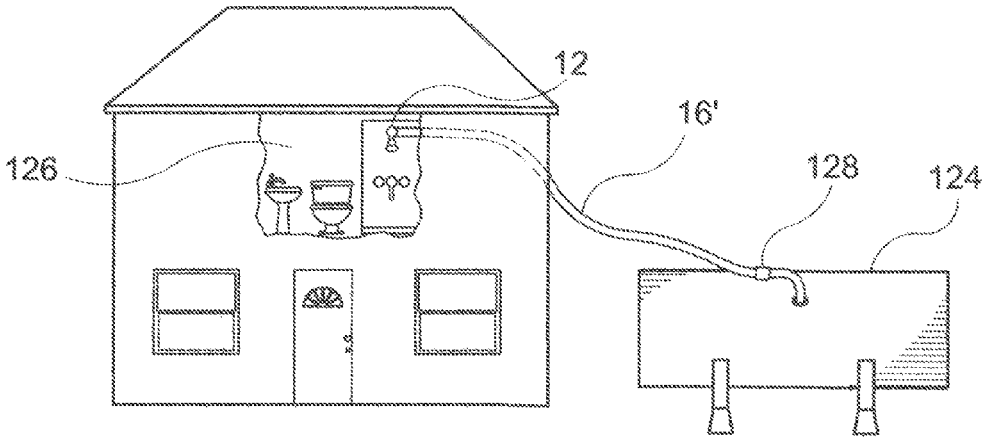
FIG. 11 shows an embodiment in which water from the diverter valve shown in FIG. 2 can be sent to one or more outdoor storage tank(s).

Cross-referencing FIGS. 2 and 11, an embodiment is shown in which the diverter valve 12 on line 14 (shown in FIG. 2) can be used to divert at least a portion of water in line 14 into line 16' for flow into one or more storage tank(s) 124 located outside of the bathroom 126. For example, storage tank 124 may be located in a garage or room outside the bathroom 126 or may be located outdoors, adjacent the home, may be covered or uncovered, or may be located in an outbuilding such as a shed or barn. Storage tank 124 may be freestanding or mounted on supports, as shown. FIG. 11 also shows that one or more filters may be provided in line 16' to filter water entering tank 124. Alternatively, or in addition thereto, one of more filters (not shown) may be provided to filter water exiting storage tank 124. Tank 124 may be located at a higher, lower or same elevation as diverter valve 12. Water in storage tank 124 may be stored for reuse, such as use as an emergency water supply, landscape watering, and/or can be used to fill a pool or pond, etc. . . . While the particular embodiment(s) are described and illustrated in this patent application in the detail required to satisfy 35 U.S.C. 112, it is to be understood by those skilled in the art that the above-described embodiment(s) are merely examples of the subject matter which is broadly contemplated by the present application. Reference to an element in the following Claims in the singular, is not intended to mean, nor shall it mean in interpreting such Claim element "one and only one" unless explicitly so stated, but rather "one or more". All structural and functional equivalents to any of the elements of the above-described embodiment(s) that are known, or later come to be known to those of ordinary skill in the art, are expressly incorporated herein by reference and are intended to be encompassed by the present Claims. It is not intended or necessary for a device or method discussed in the Specification as an embodiment, to address or solve each and every problem discussed in this Application, for it to be encompassed by the present Claims. No element, component, or method step in the present disclosure is intended to be dedicated to the public regardless of whether the element, component, or method step is explicitly recited in the Claims. No claim element in the appended Claims is to be construed under the provisions of 35 U.S.C. 112, sixth paragraph, unless the element is expressly recited using the phrase "means for" or, in the case of a method claim, the element is recited as a "step" instead of an "act".

What is claimed is:

1. A system comprising;

a hot water line;

a first cold water line;

a mixing valve assembly receiving water from the hot water line and cold water line and outputting water to a mix line;

a diverter valve receiving water from the mix line and having a first output and a second output;

a dispenser positioned to receive water from the first output;

a sealed storage tank positioned to receive water from the second output, the sealed storage tank having an overflow port;

an overflow line having a first end attached to the overflow port of the sealed tank to flow overflow water upwardly from the tank to a second open overflow line end attached to the diverter valve to direct overflow water from the second open overflow line end to a drain; and a toilet cistern having a first float valve responsive to cistern water level to control flow of water from the storage tank to the toilet cistern and a second float valve responsive to cistern water level to control flow of water from a second cold water line to the toilet cistern.

2. The system as recited in claim 1 wherein the dispenser is selected from the group of dispensers comprising a showerhead, shower wand, showerhead-wand combination and a tub spout.

3. The system as recited in claim 1 further comprising a thermostatic shutoff valve positioned to receive water from said second output.

4. The system as recited in claim 1 further comprising a temperature indicator indicating water temperature in said mix line.

5. The system as recited in claim 1 further comprising a check valve positioned to receive water from said second output.

6. The system as recited in claim 1 wherein the diverter valve includes three discrete lever positions allowing manual adjustment between positions.

* * * * *